US006547242B1

(12) United States Patent
Sugiyama et al.

(10) Patent No.: US 6,547,242 B1
(45) Date of Patent: Apr. 15, 2003

(54) GAME OF CHANCE METHOD AND APPARATUS

(75) Inventors: Arata Sugiyama, Zama (JP); Muneharu Sameshima, Suginami (JP); Max Hiraga, Las Vegas, NV (US); Mike Farnham, Hendersen, NV (US)

(73) Assignee: Konami Gaming, Inc., Las Vegas, NV (US)

( * ) Notice: Subject to any disclaimer, the term of this patent is extended or adjusted under 35 U.S.C. 154(b) by 0 days.

(21) Appl. No.: 09/690,957

(22) Filed: Oct. 17, 2000

(51) Int. Cl.[7] ..... A63B 71/00

(52) U.S. Cl. ..... 273/142 R; 273/138; 273/143; 463/20; 463/46

(58) Field of Search ..... 273/142 R, 292, 273/143, 138.2; 463/20, 46

(56) References Cited

U.S. PATENT DOCUMENTS 5,429,507 A * 7/1995 Kaplan ..... 434/112
5,772,506 A * 6/1998 Marks et al. ..... 463/13
5,848,932 A * 12/1998 Adams ..... 463/20
6,105,962 A * 8/2000 Malavazos et al. ..... 273/143 R
6,129,355 A * 10/2000 Hahn et al. ..... 273/142 R
6,152,447 A * 11/2000 Stanley ..... 273/138.1
6,173,955 B1 * 1/2001 Perrie et al. ..... 273/146
6,305,686 B1 * 10/2001 Perrie et al. ..... 273/146

FOREIGN PATENT DOCUMENTS

GB 2 137 392 A * 10/1984 ..... G07F/17/34
GB 2 165 385 A * 4/1986 ..... G07F/17/34
GB 2 226 436 A * 6/1990 ..... G07F/17/34
GB 2 242 300 A * 9/1991 ..... G07F/17/34

* cited by examiner

*Primary Examiner*—Benjamin H. Layno
*Assistant Examiner*—D. Collins
(74) *Attorney, Agent, or Firm*—Phillip J. Anderson; Anderson & Morishita, LLC

(57) ABSTRACT

Disclosed herein is an apparatus and method for playing a game of chance. The game of chance includes a multi-reel slot game and one or more matrices. In one embodiment, one matrix per payline configuration is made available. When a special symbol appears on a reel it is activated on the corresponding matrix in a corresponding cell of the matrix. When the special symbols align in the matrix according to the payline in question, a winning outcome occurs. In another embodiment, a plurality of special symbols are available on said reels. One matrix per special symbol is provided. When special symbols appear on the reel selected paylines they are activated in like cell positions on the appropriate matrix. When the a matrix is filled a winning outcome occurs and the player may qualify for an eligibility game that may provide additional awards to a player.

4 Claims, 14 Drawing Sheets

GAME OF CHANCE METHOD AND APPARATUS

BACKGROUND OF THE INVENTION

1. Field of the Invention

The present invention relates generally to games of chance. More particularly, the present invention relates to an apparatus and method for games of chance of the slot variety.

2. The Prior Art

Various games of chance have been promoted throughout the years with varying degrees of success. One particularly popular game of chance is the slot machine type game. Generally speaking, slot machines include at least three reels, either mechanically operated or depicted on a video screen. Upon activation, the reels spin and stop in a random manner. Symbols depicted on the reels, when arranged according to a pay table, can result in a winning event and a player may receive credits or monetary awards.

Many have attempted to provide greater excitement to the traditional slot game by various means. For instance, slot games had been grouped together on networks to form progressive pools so that greater jackpots could be achieved. Additionally, adding more and more paylines to traditional slot games has been tried with some success in certain jurisdictions to provide greater player entertainment. Further, certain bonus games dependent on the primary reel game have been touted with both limited and greater success. However, such bonus games are typically confusing and complicated for the player.

A continuing need exists to provide ever more exciting slot games that are both simple for the player to understand and exciting for the player to play.

BRIEF DESCRIPTION OF THE INVENTION

To overcome these and other shortcomings of the prior art, disclosed herein is an apparatus and method for playing a slot game which includes a matrix game that is triggered by the slot game. More particularly, the present invention depicts a reel slot game and a matrix, wherein the elements of the matrix are made active by results on the reels. When the elements of the matrix combine according to a pay table, one or more awards may be credited or paid to a player in addition to awards determined according to reel stop positions.

It is therefore an object of the present invention to provide a more entertaining slot game than known heretofore.

It is another object of the present invention to provide a slot game which pays according to a pay table based on reel symbol positions, and also activates special symbols on a display matrix when those special symbols appear on selected paylines on the reels.

It is another object of the present invention to award players according to a pay table when activated special symbols align in a predetermined manner.

It is yet another object of the present invention to provide a reel slot game and a plurality of matrices, each of which may include activated special symbols when those symbols appear on the reels.

It is also an object of the present invention to provide a reel slot game and a plurality of matrices where when special symbols are aligned and activated in a predetermined manner makes eligible play of another game which may provide additional awards.

Viewed from a first vantage point a method for playing a game of chance is disclosed comprising presenting a plurality of reels on a display, the reels including a plurality of symbols depicted thereon; providing at least one payline on the reels; presenting at least one matrix, the matrix including a plurality of cells corresponding to stop positions on the reels; spinning the reels and stopping the spinning reels; determining whether a winning outcome has occurred according to the stopped reel symbol positions as compared to one or more predefined winning outcomes; activating a special symbol in each cell of the at least one matrix in a cell position corresponding to the special symbol location on the reels when a special symbol. appears on the at least one reel payline; determining whether a winning outcome has occurred according to the location of the activated special symbols on the at least one matrix; and notifying the player of a win in the event at least one winning outcome has been determined.

Viewed from another vantage point a program storage device readable by a machine, tangibly embodying a program of instructions executable by the machine to perform a method for playing a game of chance is disclosed, the method comprising in combination presenting a plurality of reels on a display, the reels including a plurality of symbols depicted thereon; providing at least one payline on the reels; presenting at least one matrix on the display, the matrix including a plurality of cells corresponding to stop positions on the reels; spinning the reels and stopping the spinning reels; determining whether a winning outcome has occurred according to the stopped reel symbol positions as compared to one or more predefined winning outcomes; activating a special symbol in each cell of the at least one matrix in a cell position corresponding to the special symbol location on the reels when a special symbol appears on the at least one reel payline; determining whether a winning outcome has occurred according to the location of the activated special symbols on the at least one matrix; and notifying the player of a win in the event at least one winning outcome has been determined.

Viewed from yet another vantage point a game of chance configured as a slot type game is disclosed comprising in combination a plurality of reels including a plurality of symbols displayable on the reels and at least one payline associated with the reels; at least one matrix configured to display special symbols on the matrix when teh special symbols appear on the reels; a reel spinning means for spinning the reels and stopping the spinning; an outcome determination means for determining the outcome of the game based on comparing a predefined winning outcome schedule with the stopped reel symbol locations and comparing the special symbol locations with the predefined winning outcome schedule; and notification means for notifying a player of a winning outcome.

These and other objects of the present invention will become manifest from the further descriptions and claims of the invention provided herein.

BRIEF DESCRIPTION OF THE DRAWING FIGURES

DETAILED DESCRIPTION OF THE INVENTION

Persons of ordinary skill in the art will realize that the following description of the present invention is illustrative only and not in any way limiting. Other embodiments of the invention will readily suggest themselves to such skilled persons having the benefit of this disclosure.

Figure 1:
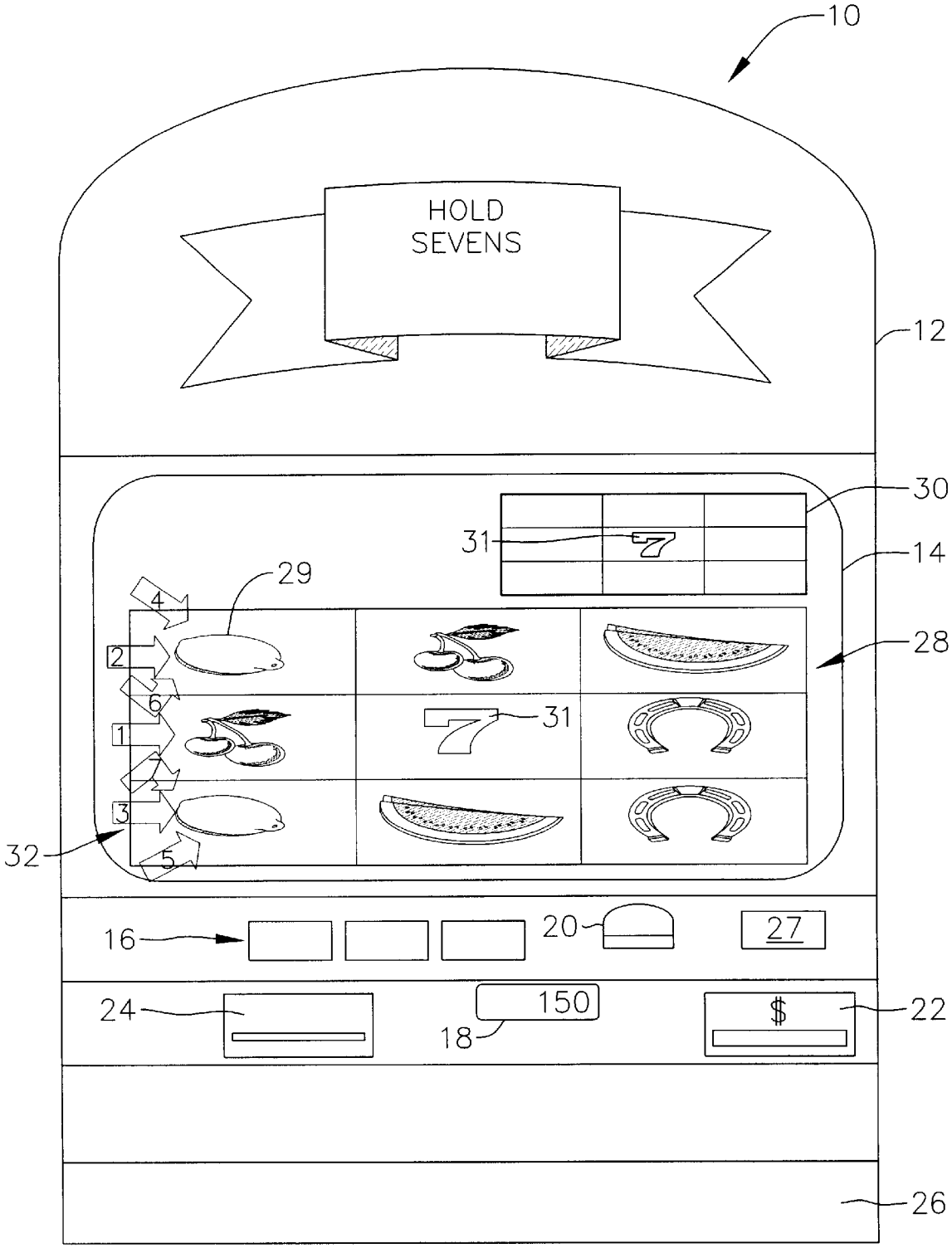
FIG. 1 is a front view drawing of a game machine of the present invention.

Referring now to the drawing figures wherein like reference numerals depict like parts throughout the various drawing figures, FIG. 1 depicts an overview of a slot machine 10. The game machine 10 includes a game cabinet 12. In this drawing figure the game cabinet 12 is depicted as an "upright" game machine. However, various game cabinets could be utilized without departing from the scope of the present invention. For instance, the game cabinet 12 could just as well be configured as a "slant-top" game cabinet wherein part of the cabinet is slanted upwardly so that a player sitting will view that section of the cabinet including the video display 14 while looking in a downward direction.

A hole in the game cabinet 12 is configured to accommodate a video display 14. Various video displays 14 could be utilized without departing from the scope of this invention. Size variations for video displays in the industry range from 13" to 19" or greater video displays and they may or may not include a "touchscreen" capability. Any such video display capable of depicting the reel and matrix arrangement to be described hereinafter is contemplated by this invention.

Furthermore, a video display 14 may not be utilized at all when mechanical reels are desired. In such a case, as will be appreciated by those skilled in the art, mechanical reels activated by stepper motors that are controlled by software will work as well, but are not preferred. Additionally, as described below, the matrix 30 is preferably a video depiction. However, that matrix can likewise be mechanically driven with stepper motors controlled by software. Thus, this invention, though preferred in the video form, is not intended to be limited to video, but may include any variations which do not depart from the meaning and scope of the described game. In fact, one clear variation of the game would be to present same on the internet or other network or via software on a computer in the absence of any cabinet or like accoutrements. This is clearly contemplated by this invention and would not depart from the scope and meaning of same.

As is common to games of chance configured as slot machines, a credit meter 18 for indicating credits available for play is included on the game cabinet 12 along with a coin slot 20 for receiving coins for play. Additionally, a bill validator 22 for receiving currency instead of coinage is included in the game cabinet 12 along with a card reader 24 for tracking player activity via a player magnetic stripe card. Furthermore, a coin payout bin 26 is included in this preferred embodiment for disbursing winnings to players upon activation of a payout button 27 by a player. Although these described elements are preferred, other game machine variations are contemplated by this invention without departing from the scope of this invention. For instance, instead of the coinage and cash handling means described above, a cashless system may be likewise utilized that incorporates coupons or smartcards instead of cash or coinage. Additionally, other incidental features such as progressive meters, signage, or other display elements are likewise contemplated by the scope of this invention and such variations would not depart from that scope.

More particularly, three reels 28 are depicted on the video display. The reels 28 include symbols 29 thereon. As will be appreciated by those skilled in the art, when symbols 29 align on selected paylines 32 according to a paytable (not shown), an award outcome occurs. Additionally, in this invention, when a special symbol 31 presents itself on a selected payline 32, that special symbol 31, in this case a "7", is replicated into matrix 30 at a cell position corresponding to the special symbol 31 position on the reels 28.

Figure 2:
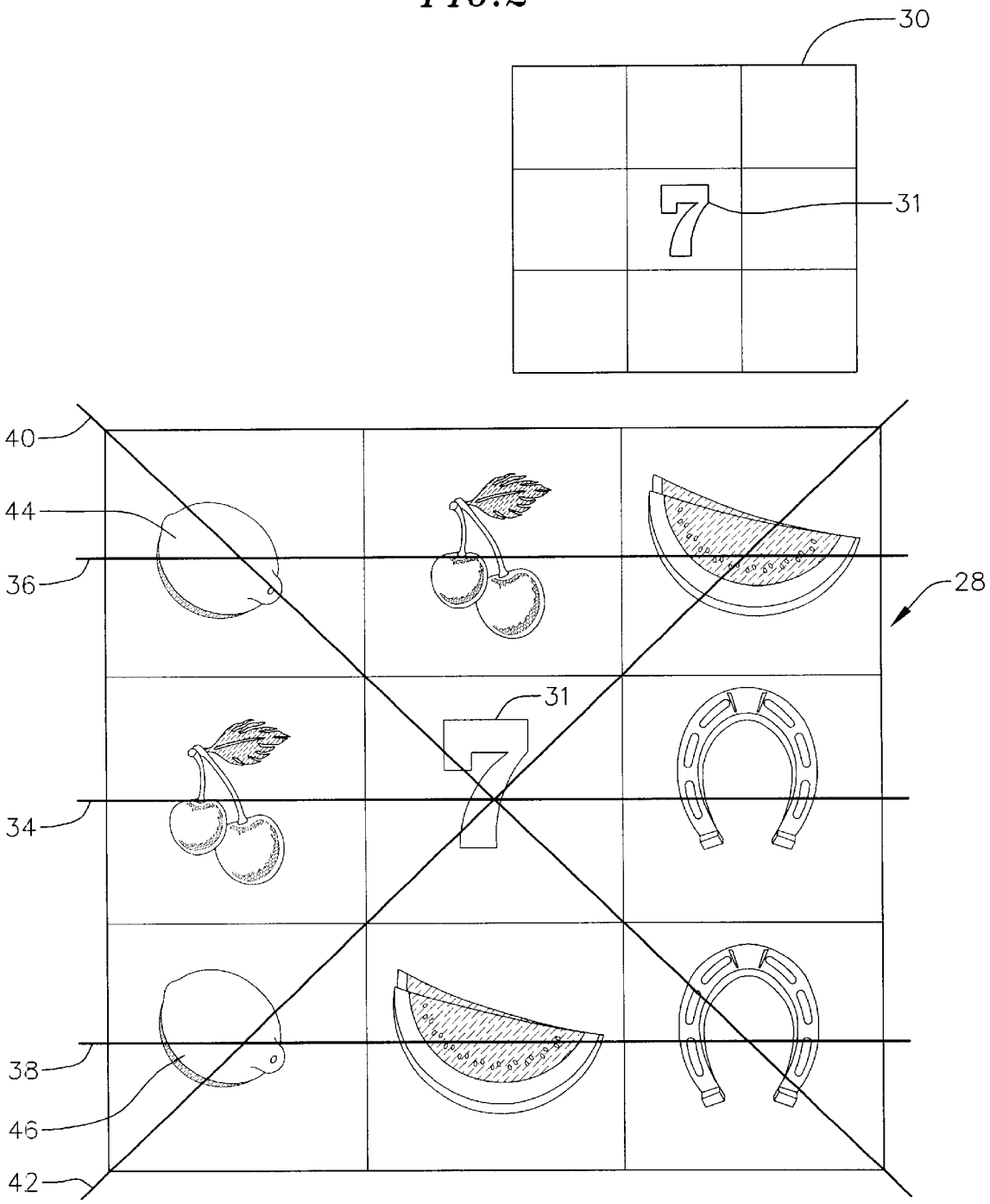
FIG. 2 is a diagram of the reels and matrix depicted in FIG. 1.

More specifically, and referring now to FIG. 2 which depicts the video display of FIG. 1 in an enlarged drawing, reels 28 have stopped in such a fashion as to present special symbol 31 in the center position of the center reel. That special symbol 31 is thus likewise activated in the center cell of matrix 30 as shown. As will be described in greater detail below, when additional special symbols 31 are replicated into matrix 30 an additional award may occur if aligned according to a paytable (not shown).

Furthermore, as shown in greater detail in FIG. 2 are paylines generally described in FIG. 1 as 32. As will be appreciated by those skilled in the art, one or more paylines may be activated depending on the number of credits a player wishes to play. For instance, a player may select the first payline 34 by playing one or more credits (many games contemplate more than one credit per payline) and selecting the first payline by touching an appropriate touch field in the event a touch-screen display is utilized, or by pressing the appropriate button 16. The paylines available for selection in this preferred embodiment are the first payline 34 extending across the center line of the reels 28, the second payline 36 extending across the top line of the reels 28, and the third payline 38 extending across the bottom line of the reels 28.

Additionally, a forth payline 40 extends diagonally from top to bottom of the reels 28, while a fifth payline 42 extends from bottom to top of the reels 28. Furthermore, this preferred embodiment includes a sixth payline 44 that extends from the top of the left reel to the center of the center reel and then to the top of the right reel, while a seventh payline 46 extends from the bottom of the left reel to the center of the center reel and then to the bottom of the right reel. Of course, as will be appreciated by those skilled in the art, any variation of paylines may be implemented with this game without departing from the scope of the invention.

Figure 3A:
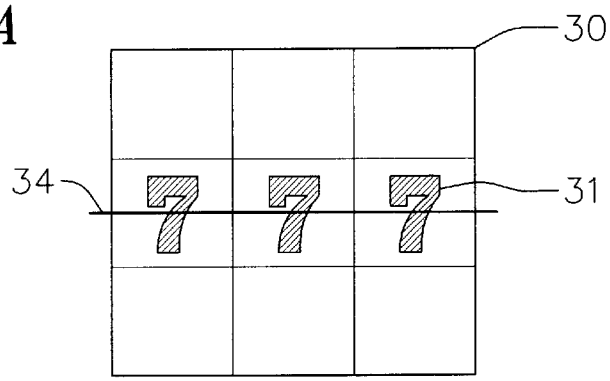
FIG. 3A is a drawing of a 3×3 matrix for a one-line game of the present invention.

Depending on the number of paylines selected, a corresponding matrix 30 is presented. That is, and referring now to FIG. 3A, when a player elects to play only the first payline on reels 28, matrix 30 as shown in FIG. 3A is presented. The special symbols 31 are shown in a grayed-out manner so as to indicate that those positions are yet to be filled in by replicated special symbols 31 from reels 28. As may be gleaned from FIG. 3A, when all three special symbols 31 are activated in matrix 30 along the corresponding payline 34 on matrix 30, a winning outcome occurs and an award is paid or credited by the game. Interestingly, when a player elects to play some other number of paylines other than one, a different matrix is presented to the player corresponding to the appropriate number of paylines as will be explained in more detail below. However, when the player chooses to return to the one line game, the matrix as shown in FIG. 3A is presented again to the player along with any activated special symbols 31 previously replicated. Thus, the game is capable of retaining in memory multiple matrices 30 along with previously acquired special symbols 31 for each matrix until a winning outcome occurs in a particular matrix resulting in the clearing of the special symbols 31. It should be noted, however, that when a special symbol 31 is activated in the matrix for the one-line game, it is preferably not activated for the other payline matrices.

Figure 3B:
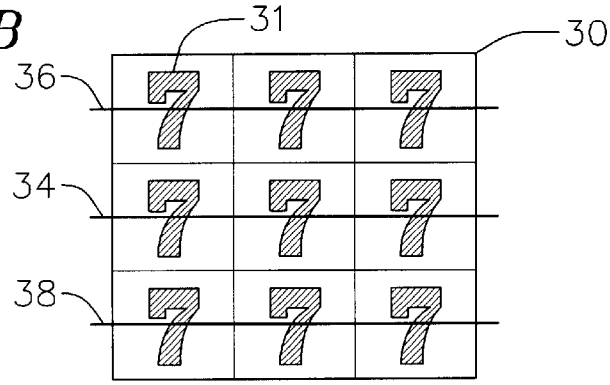
FIG. 3B is a drawing of a 3×3 matrix for a three-line game of the present invention.

Similarly, and referring now to FIG. 3B, a three-line matrix 30 corresponding to a three-line reel game is shown again with the special symbols 31 grayed out. In this three-line matrix when three special "7" symbols 31 align according to any of the three paylines 34, 36, or 38, a winning outcome occurs resulting in an award. For instance, if all three special "7" symbols become activated after several spins of the reels on payline 36 on matrix 30 of FIG. 3, an award is credited to the player and the three special symbols reset or are grayed out again. However, any other activated special "7" symbols 31 on that matrix will remain active until a winning outcome occurs causing them to be deactivated or reset. Furthermore, any special "7" symbols activated in the matrix shown in FIG. 3B are not preferably activated in the matrix of FIG. 3A or any other matrices.

Figure 3C:
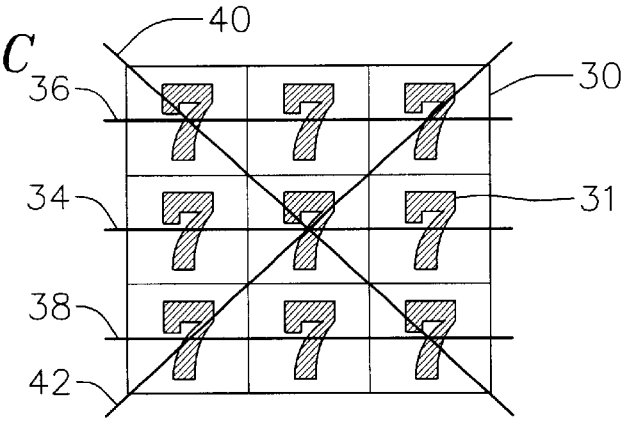
FIG. 3C is a drawing of a 3×3 matrix for a five-line game of the present invention.

Likewise, and referring now to FIG. 3C, a matrix 30 corresponding to a five-line game is shown. The addition of paylines 40 and 42 indicate the forth and fifth paylines for this matrix 30. Although, similar to the last two described matrices, it is noted again that special symbols 31 activated in this matrix 30 are not preferably activated in the matrices of FIGS. 3A or 3B, but are maintained in memory for any future five-line game players.

Figure 3D:
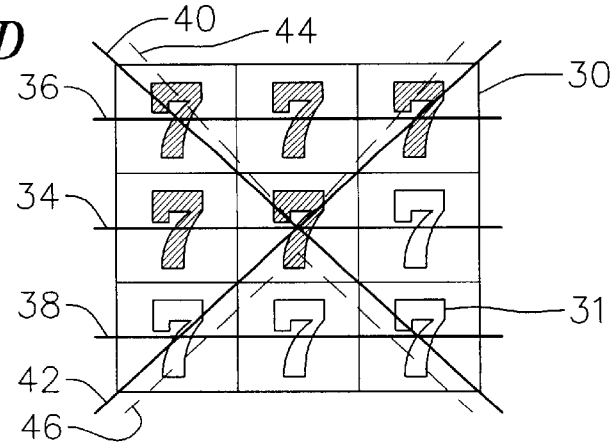
FIG. 3D is a drawing of a 3×3 matrix for a seven-line game of the present invention.

This is also true for the seven-line matrix 30 depicted in FIG. 3D. The only difference is the addition of paylines 44 and 46. Again, this matrix only applies to those players playing all seven lines. Thus, depending on the number of paylines played by a player, different matrices 30 are presented on display 14 along with previously activated special symbols 31 for that particular number of paylines.

Figure 4A:
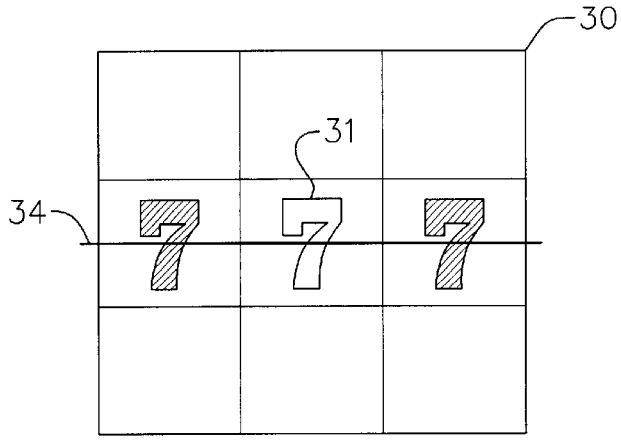
FIG. 4A is a drawing depicting an example of a one-line game in a first state of the present invention.
Figure 4A:
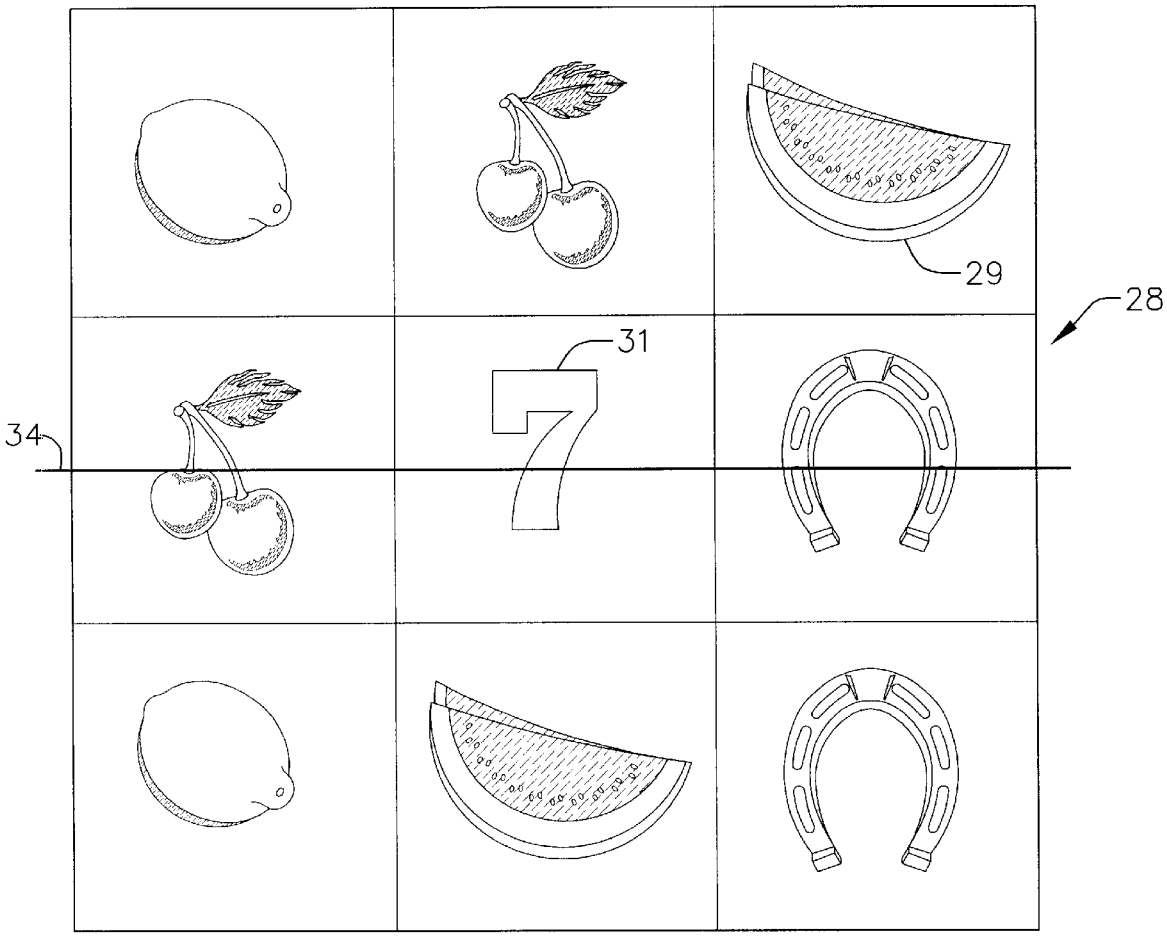
Figure 4B:
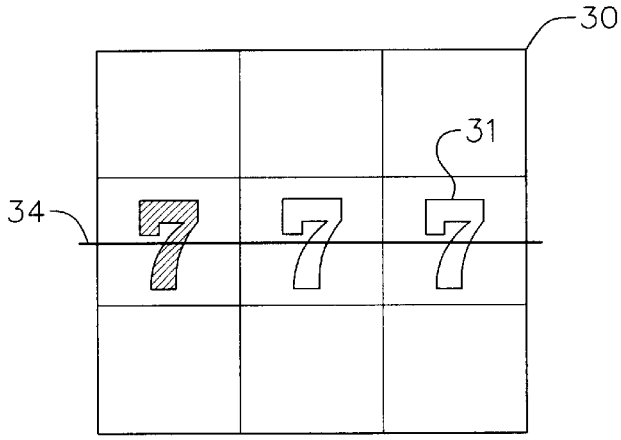
FIG. 4B is a drawing depicting an example of a one-line game in a second state of the present invention.
Figure 4B:
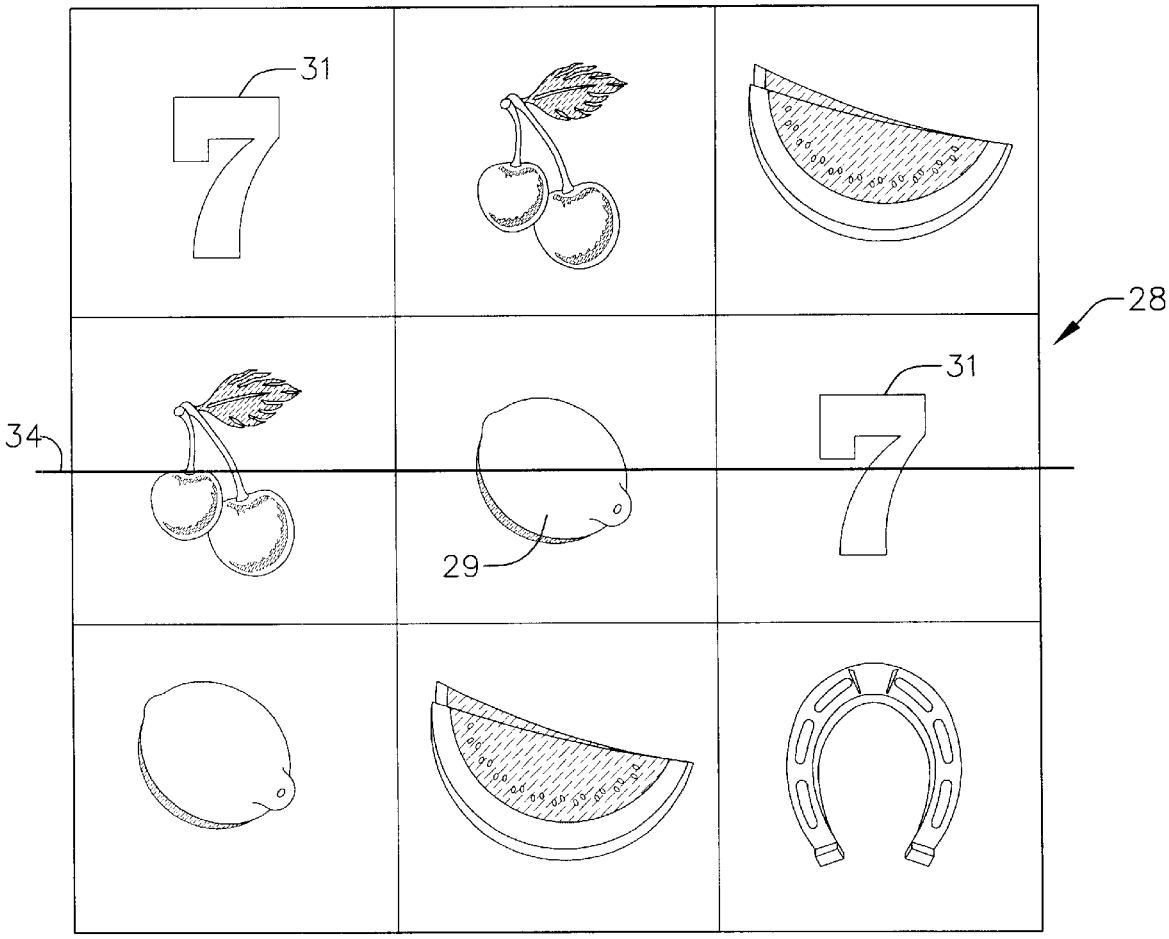

By way of example, but not limitation, and referring now to FIGS. 4A and 4B, a one-line game is shown in a first state (FIG. 4A) and a second state (FIG. 4B). In the first state as depicted in FIG. 4A, one payline 34 has been selected and one special "7" symbol 31 has appeared on the center of that payline 34. This has resulted in the activation of special symbol 31 in the one-line matrix 30 above the reels 28. The remaining special "7" symbols 31 on the payline 34 on the matrix 30 remain grayed out as they have not yet appeared on the corresponding reel 28 positions for one-line players.

At some later time, perhaps the next spin of the reels or some many spins later, the state depicted in FIG. 4B occurs. It should be noted that intervening spins may have resulted in special symbols 31 landing on the center line 34 but during non-one-line games, thus not resulting in activation on the one-line matrix 30. In this particular spin, however, the player elected to play one-line 34 and a special "7" symbol 31 appeared on payline 34 on the right reel 28. This results in the corresponding special "7" symbol 31 being activated in the right center element of the matrix 30 as shown. As noted above, and as shown in this example as well, a special symbol 31 also appeared in the top right position of the left reel, however, this resulted in no special "7" symbol activation on the one-line matrix (or any other matrix) because that special symbol is not on the selected payline.

Figure 5A:
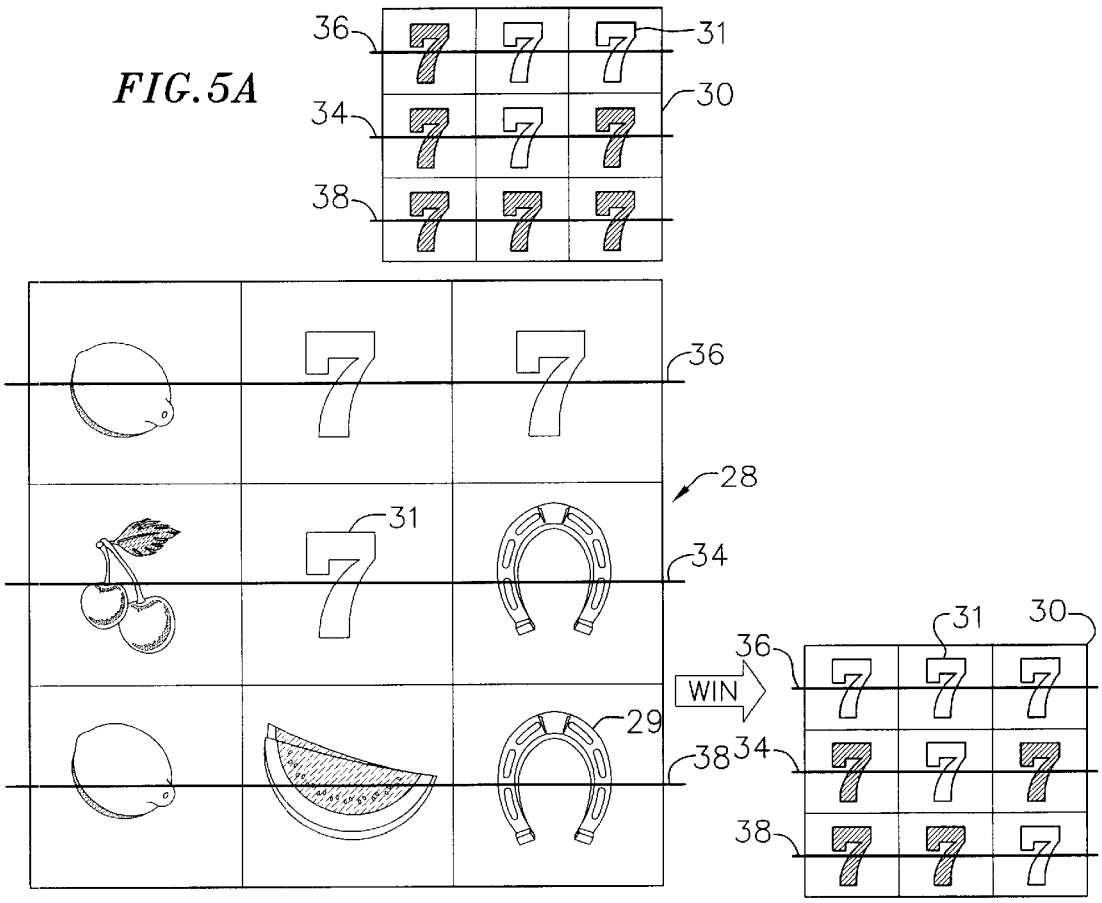
FIG. 5A is a drawing depicting an example of a three-line game in a first state of the present invention.
Figure 5B:
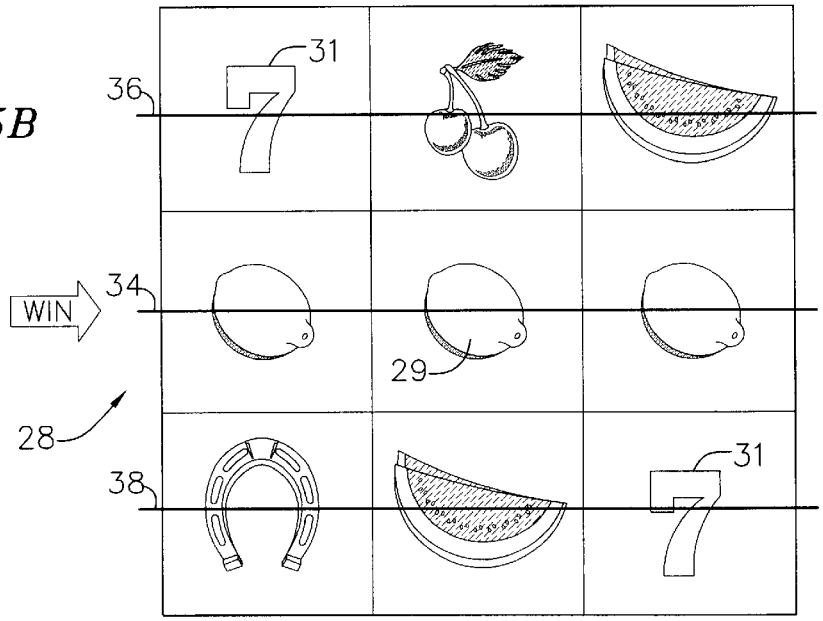
FIG. 5B is a drawing depicting an example of a three-line game in a second state of the present invention.

In another example, and referring now to FIG. 5A and FIG. 5B, a three-line first game state (FIG. 5A) and second game state (FIG. 5B) are shown. In this example, three paylines 34, 36, and 38 have been selected and two special "7" symbols 31 appeared on payline 36 and one on payline 34. The corresponding special symbols 31 were activated on the matrix 30 as shown in FIG. 5A. Thereafter, on some later spin of reels 28 the outcome shown in FIG. 5B occurred. As shown in FIG. 5B, three (lemons) symbols 29 occurred on payline 34 resulting in a standard winning outcome which is paid according to the paytable. Also, special "7" symbols 31 appeared on paylines 36 and 38. Corresponding cells in matrix 30 for the three-line game were thus activated. Since all three special symbols 31 were activated on payline 36 another winning outcome occurred for the player resulting in a second award. Thereafter, those three special symbols would be deactivated or grayed out, however, the other activated special symbols in lines 34 and 38 of matrix 30 would remain activated.

Figure 6A:
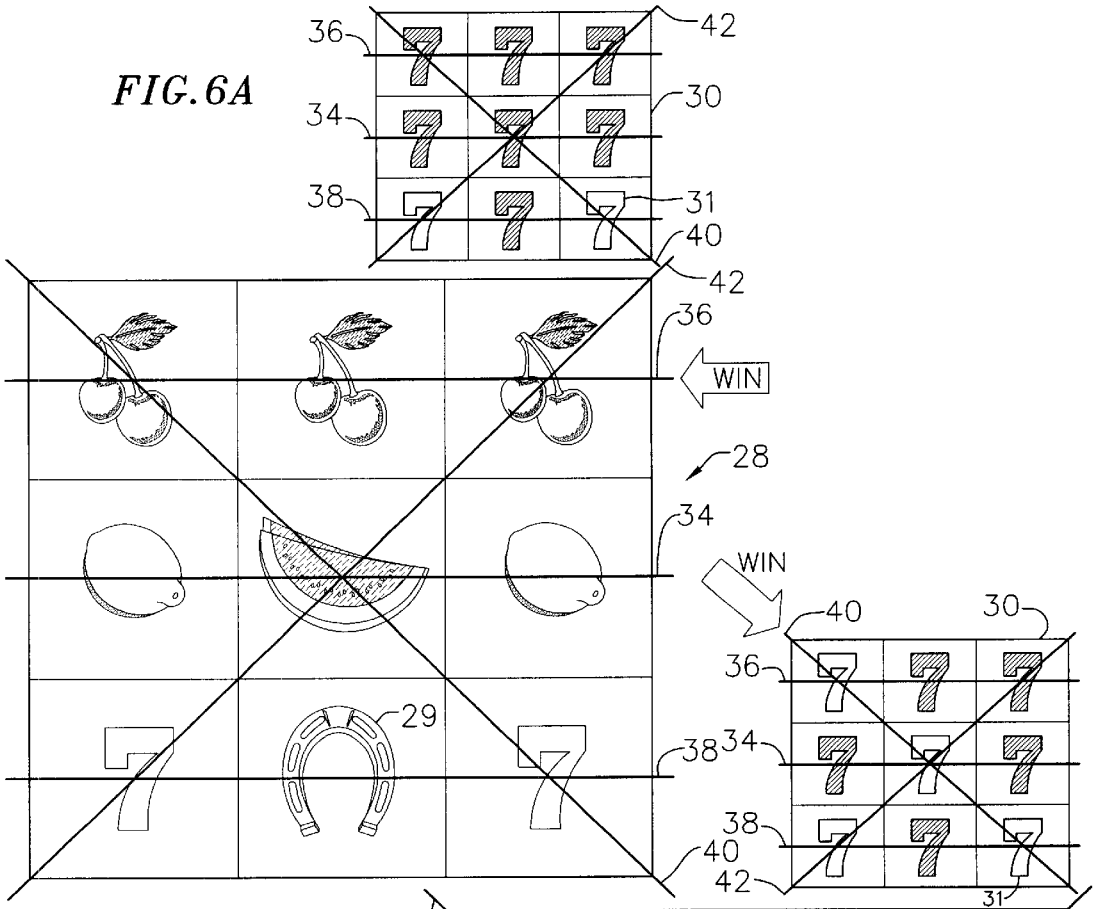
FIG. 6A is a drawing depicting an example of a five-line game in a first state of the present invention.
Figure 6B:
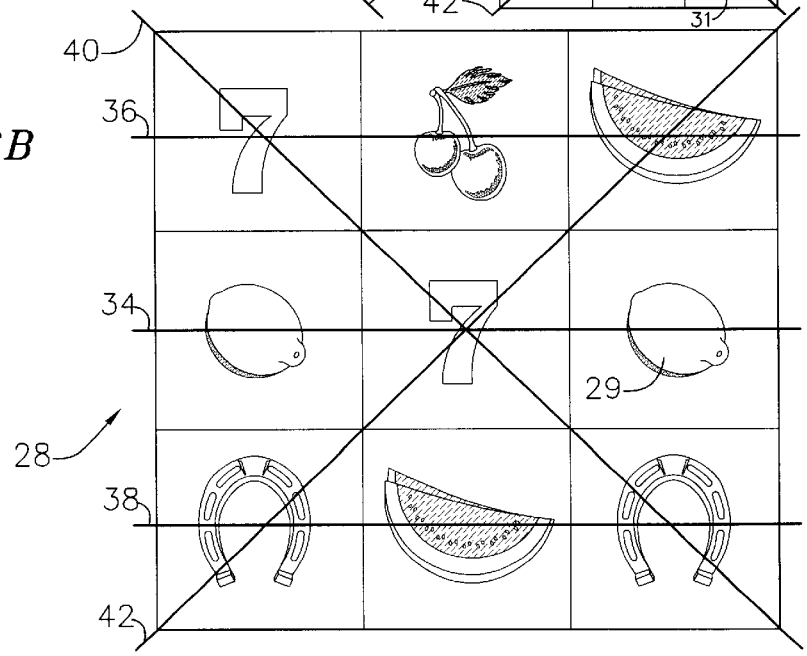
FIG. 6B is a drawing depicting. an example of a five-line game in a second state of the present invention.

In yet another example, and referring now to FIG. 6A and FIG. 6B, a five-line first game state (FIG. 6A) and a five-line second game state (FIG. 6B) are shown. In this example the player has elected to play five paylines 34, 36, 38, 40, and 42. In the first game state the player is awarded for a winning event on payline 36 (three cherries in a row) and two special symbols 31 are activated in corresponding reel to cell locations on matrix 30. Thereafter, after some future spin of the reels in a five-line game selection, the result shown in FIG. 6B occurred. Due to the special symbols 31 appearing on reels 28 activation of corresponding special symbols occurred in matrix 30 resulting in a winning outcome along payline 40. It should be noted that although three activated special "7" symbols are shown in the bottom left cell, the middle cell, and the bottom right cell of matrix 30, this does not result in a winning outcome for the five-line game as it would in a seven-line game.

Figures 7A, 7B:
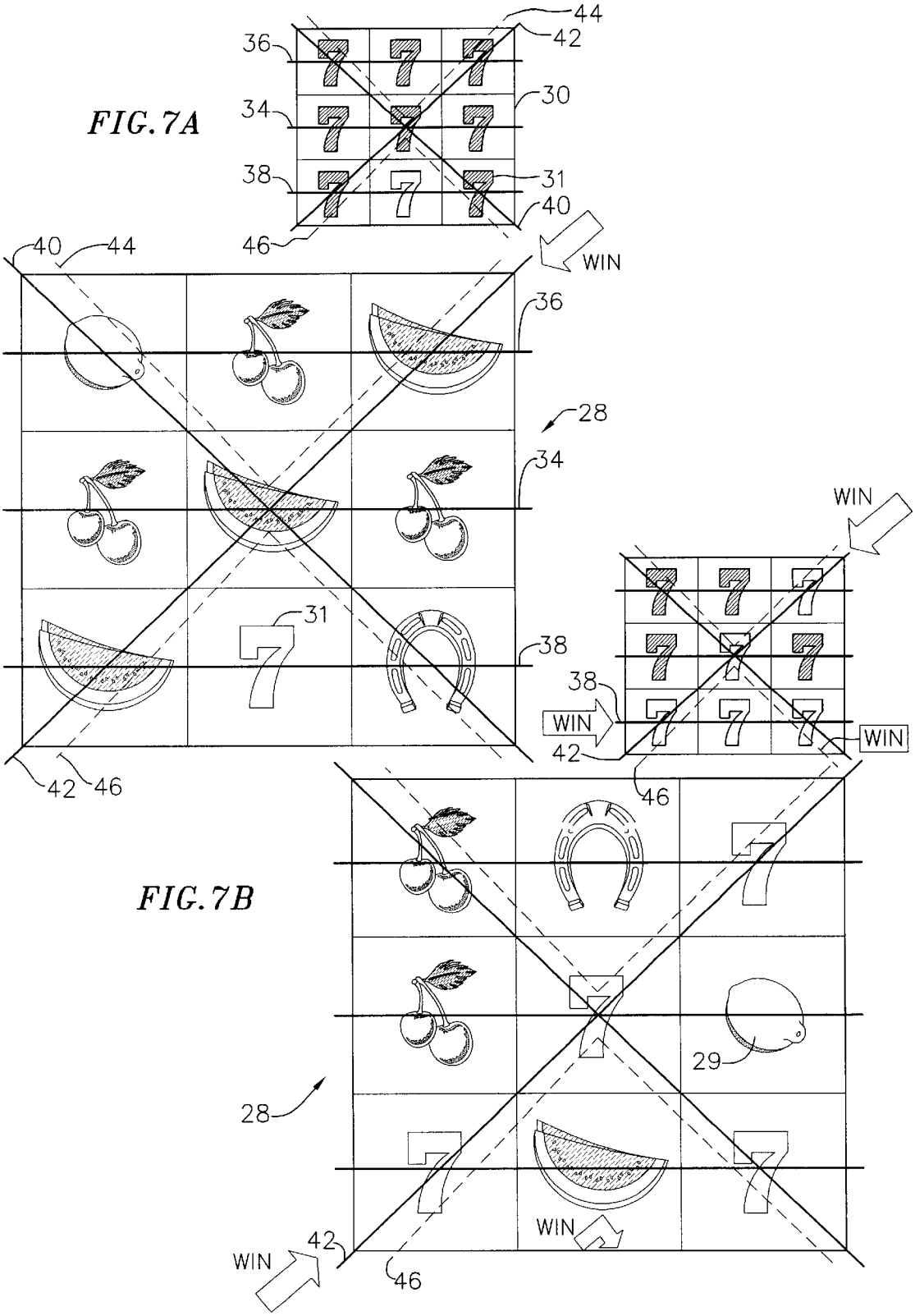
FIG. 7A is a drawing depicting an example of a seven-line game in a first state of the present invention.
FIG. 7B is a drawing depicting an example of a seven-line game in a second state of the present invention.

In a final example, and referring now to FIG. 7A and FIG. 7B a first seven-line game state (FIG. 7A) and a second seven-line game state (FIG. 7B) are shown. In this example, a player has elected to play seven paylines 34, 36, 38, 40, 42, 44, and 46. In the first game state depicted in FIG. 7A the reels 28 stopped resulting in a winning outcome on payline 42 (three watermelons) and a special symbol 31 was activated on the matrix 30 in the bottom middle cell. Thereafter, due to another spin of the reels 28, the results shown in FIG. 7B occurred. Two winning outcomes are noted on the reels 28. First, three "7" symbols aligned on payline 42 resulting in a winning outcome. Also, three "7" symbols aligned on payline 46 resulting in another winning outcome. Then, due to those same "7" symbols, activation occurred in matrix 30 in like cell positions resulting in three more winning outcomes. First, a win occurred along payline 42 on matrix 30. Then another win occurred along payline 38 on matrix 30. Then, yet another win occurred along payline 46 on matrix 30.

Figure 8:
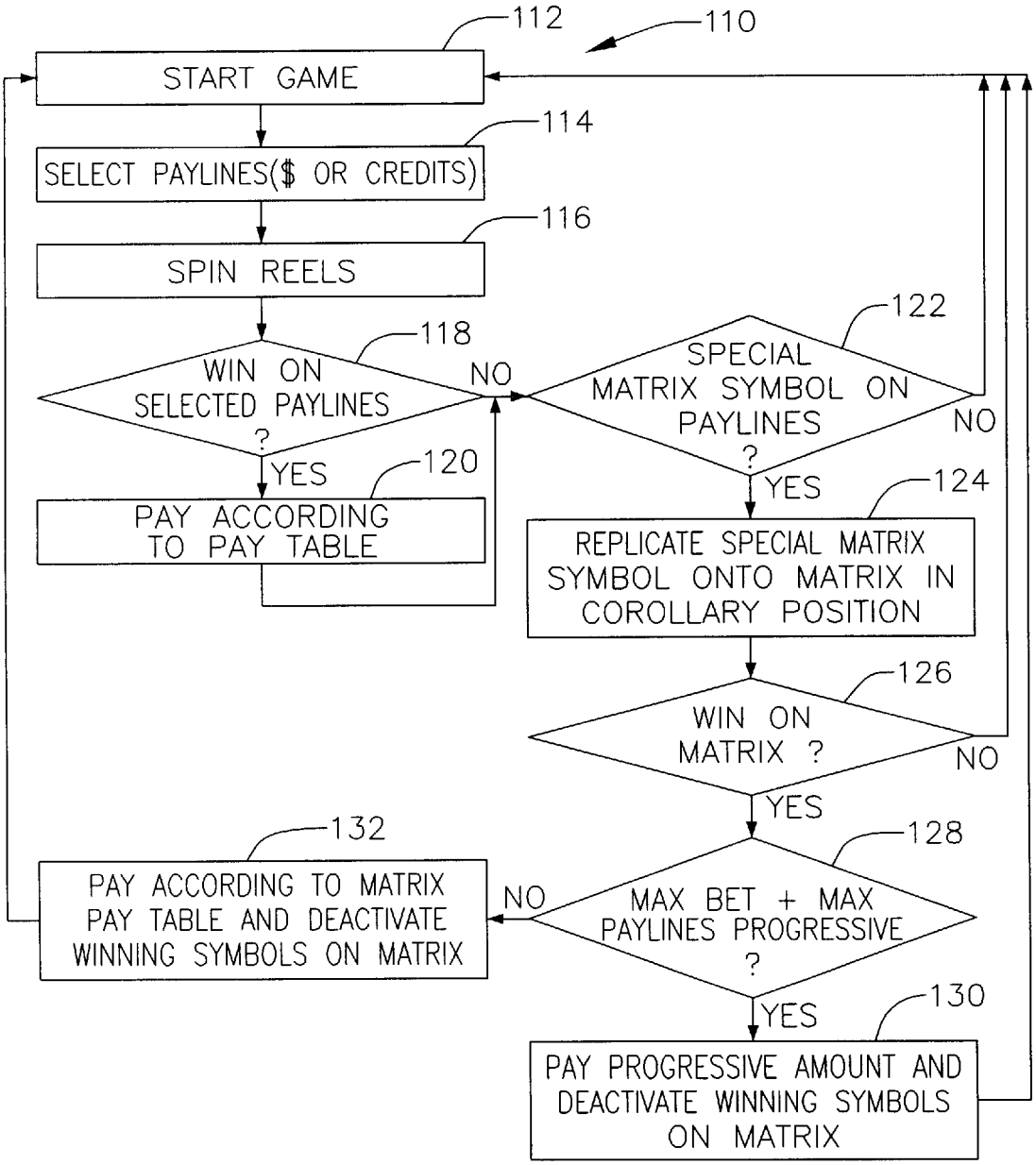
FIG. 8 is a flowchart of the method of the present invention.

The overall methodology 110 of the preferred embodiment of the game is shown in the flowchart at FIG. 8. As shown, the game is started at box 112 and a player selects paylines at box 114. Those paylines may be purchased with previously purchased credits or money or the game may be played merely for fun with free credits. Thereafter, at box 116, the reels spin (either automatically due to maximum credits being played or by the player depressing an appropriate spin activation button or touch field) and then come to a stop.

First, a determination is made as to whether a winning event has occurred due to the alignment of symbols on the selected paylines on the reels 28 as shown at decision diamond 118. If such a winning outcome has occurred on the reels 28 the player is paid or credited according to the game paytable as shown at box 120.

Then, whether a win occurred on the reels 28 or not, a determination is made as to whether any special symbol 31 landed on any of the selected paylines as shown at decision diamond 122. If no special symbols 31 landed on selected paylines, then the process starts over at box 112. On the other hand, if a special symbol 31 did appear on the reels 28 on a selected payline, then the matrix 30 replicates or activates the corresponding symbol position or positions as shown in box 124.

Next, a determination is made as to whether the newly activated symbols have caused a winning event to occur in the matrix 30 as shown at decision diamond 126. If no winning outcome is found on matrix 30, then the process starts over at box 112. On the other hand, if a winning outcome has occurred in matrix 30 then a determination is made as to whether the progressive jackpot should be paid due to the player having played the maximum amount on the maximum number of paylines as shown at decision diamond 128. If the player meets the progressive guidelines, the player is paid whatever amount the progressive jackpot is currently at and the winning symbols on matrix 30 are deactivated as shown at box 130 and the process starts over at box 112. Otherwise, the player is paid according to the matrix paytable and the winning symbols on matrix 30 are deactivated as shown at box 132 and the process starts over at box 112.

Figure 9:
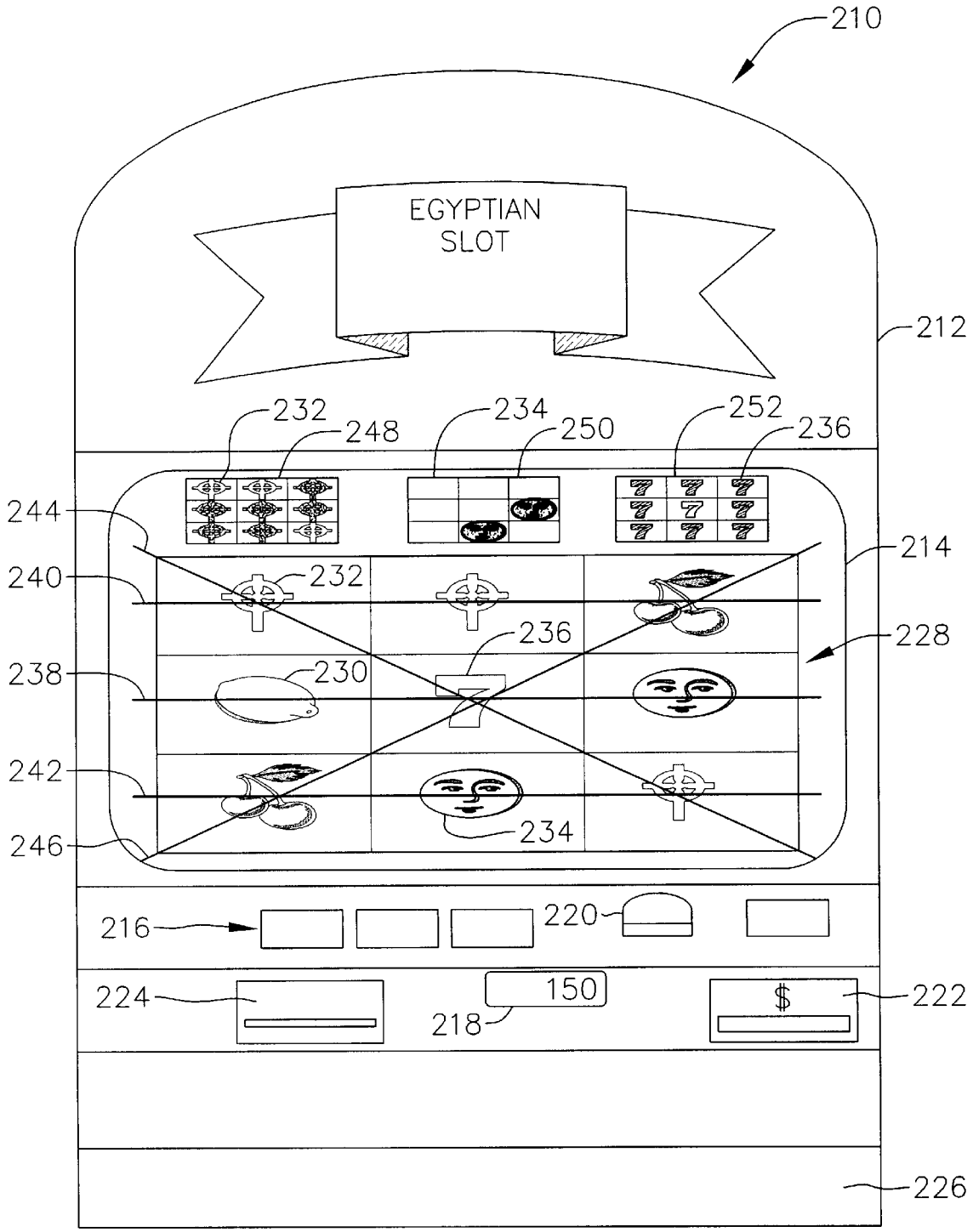
FIG. 9 is a front view of an alternate embodiment of a gaming machine of the present invention.

In an alternate embodiment of the invention 210, and referring now to FIG. 9, a similar slot machine is shown. The slot machine again includes a cabinet 212, a video display 214, buttons 216, credit meter 218, coin slot 220, bill validator 222, card reader 224, and payout bin 226 not unlike those described in FIG. 1 above.

Figure 10:
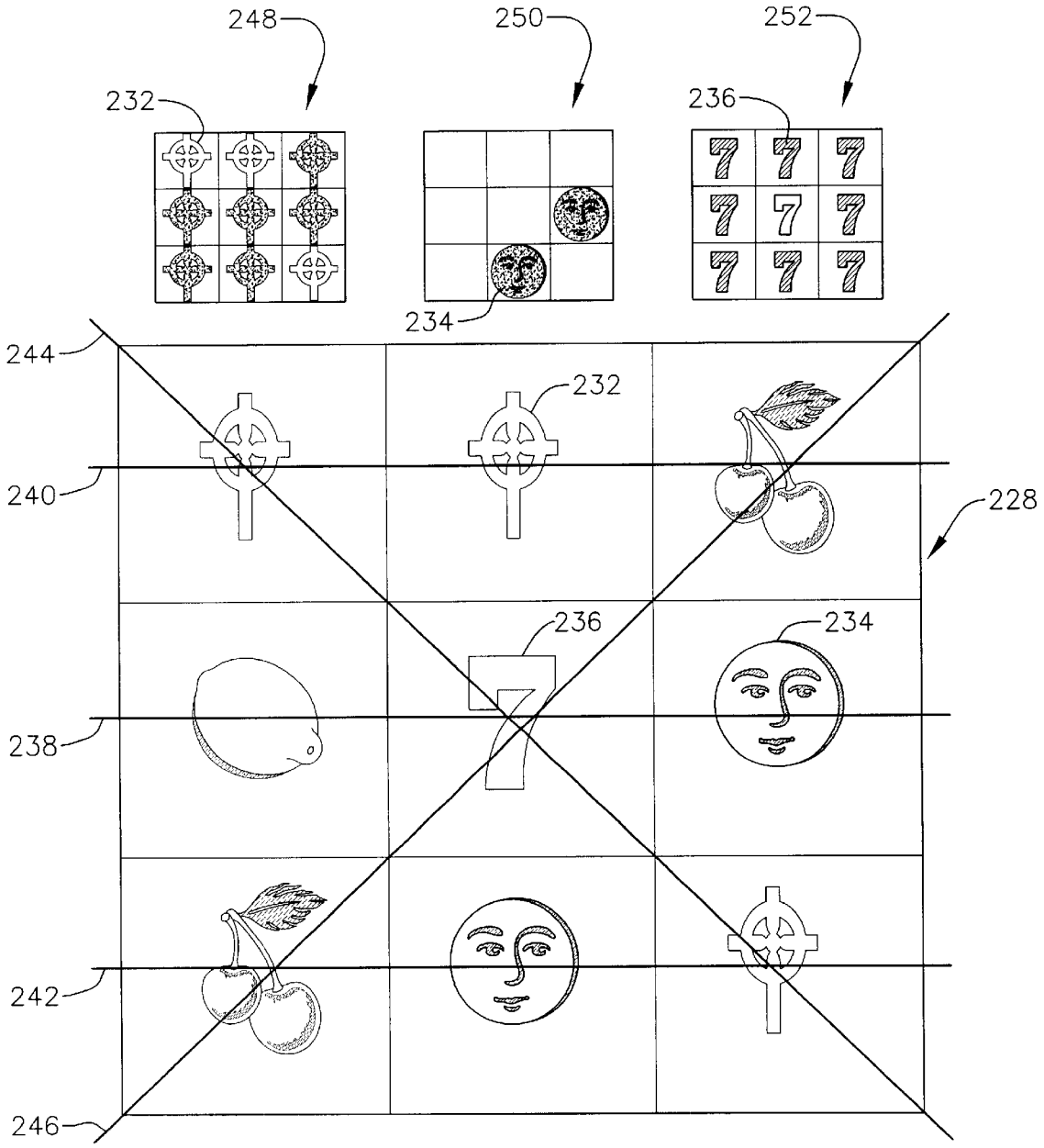
FIG. 10 is a drawing of the reels and matrices shown in the display of FIG. 9.

Referring now also to FIG. 10, reels 228 are depicted on the video display 214 and five possible paylines 238, 240, 242, 244, and 246 are shown. In this embodiment, three special symbols 232, 234, and 236 are available in addition to standard symbols 230. Additionally, three matrices 248, 250, and 252 are presented—one for each special symbol.

Like the game of the preferred embodiment, when a special symbol appears on the reels on a selected payline, it is activated on a matrix, but in this embodiment, each special symbol has a unique matrix. That is, when the special symbol 232 appears on the reels on a selected payline, it is activated in a corresponding position in matrix 248. Likewise, when special symbol 234 appears on selected paylines of reels 228, a corresponding symbol 234 in a corresponding location is activated in matrix 250. The same correspondence is true for special symbol 234 and matrix 252.

In this game embodiment, when a matrix is filled with its special symbols a winning outcome occurs. The first matrix 248 provides a first (and lowest) winning outcome when filled. The second matrix 250 provides a second (and middle) winning outcome when filled. The third matrix 252 provides a third (and largest) winning outcome when filled as well as making the player eligible to play an eligibility game to be described in more detail below.

For example, as shown in the presented reel positions, three special symbols 232 have appeared and are likewise activated in matrix 248. Those special symbols will remain active in matrix 248 until all of the special symbols 232 are activated, at which time a winning outcome will occur and all of the special symbols 232 will be deactivated or grayed out so that the matrix can be filled again. Likewise special symbols 234 as presented on the reels 228 are activated in corresponding locations in matrix 250 and special symbol 236 on reel 228 are activated in a corresponding locating on matrix 252.

As noted above, the filling of each matrix 248, 250, or 252 results in a winning outcome and an award be paid or credited to the player. Additionally, when matrix 252 is filled, not only is a winning outcome determined and an award paid, but the player then also becomes eligible to play another game altogether.

Figure 11:
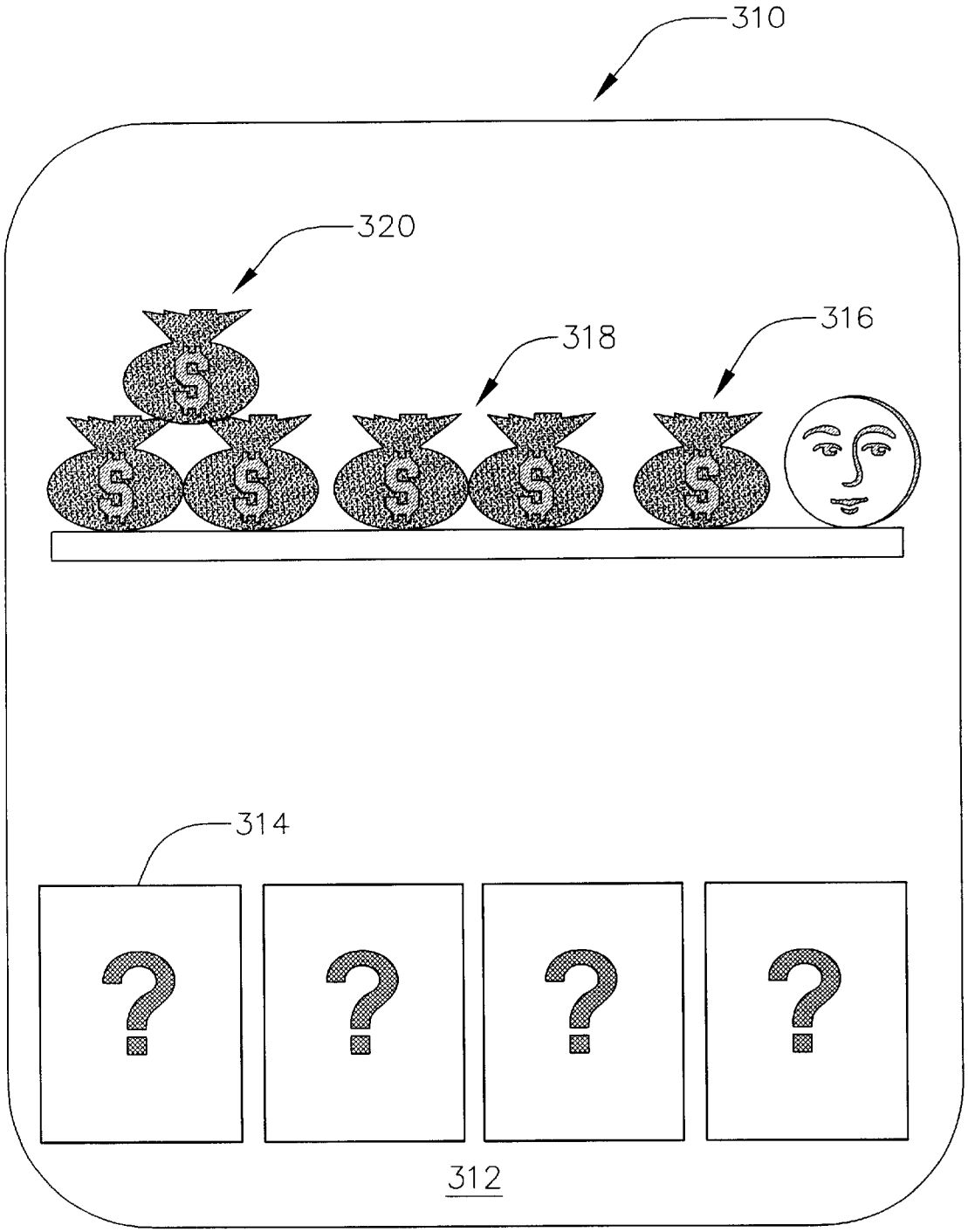
FIG. 11 is a drawing of a display of the eligibility game of the of the alternate embodiment of the present invention.

Referring now to FIG. 11 the preferred eligibility game 310 is shown. The game 310 is depicted on video display 312 which may be the same display 214 used for the primary game. The eligibility game 310 includes preferably four cards 314 being presented face down on display 312. The player must then select two of the four cards either by depressing certain of buttons 216 or touching touch fields (not shown) over the cards 314. If the selected two cards 314 match, the player wins a first prize 316. Play continues in like fashion until the player guesses incorrectly three times or the other prizes 318 and 320 have been obtained through correct guesses, whichever comes first.

Figure 12:
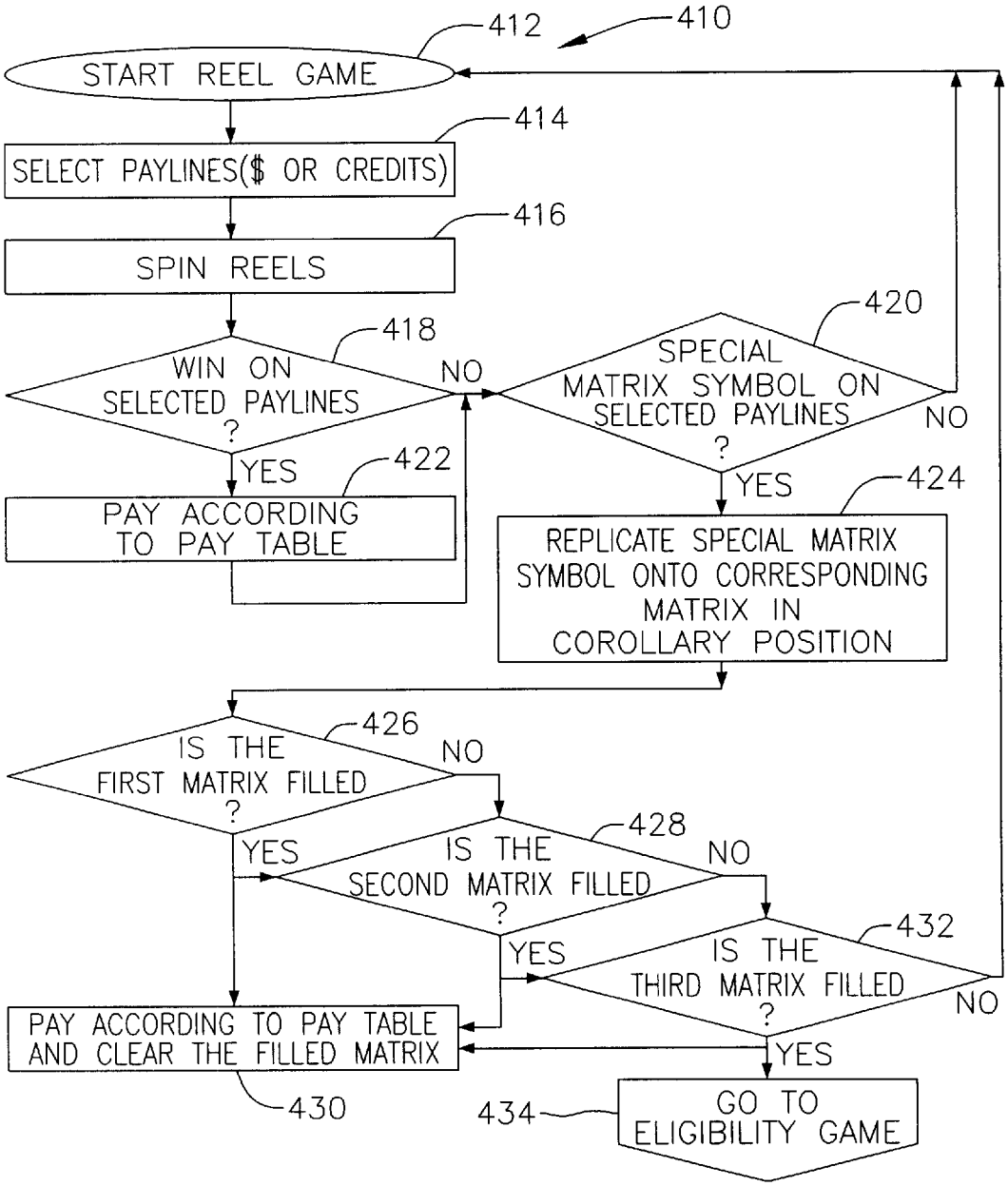
FIG. 12 is a flowchart of the method of the alternate embodiment prior to entering the eligibility game of the present invention.
Figure 13:
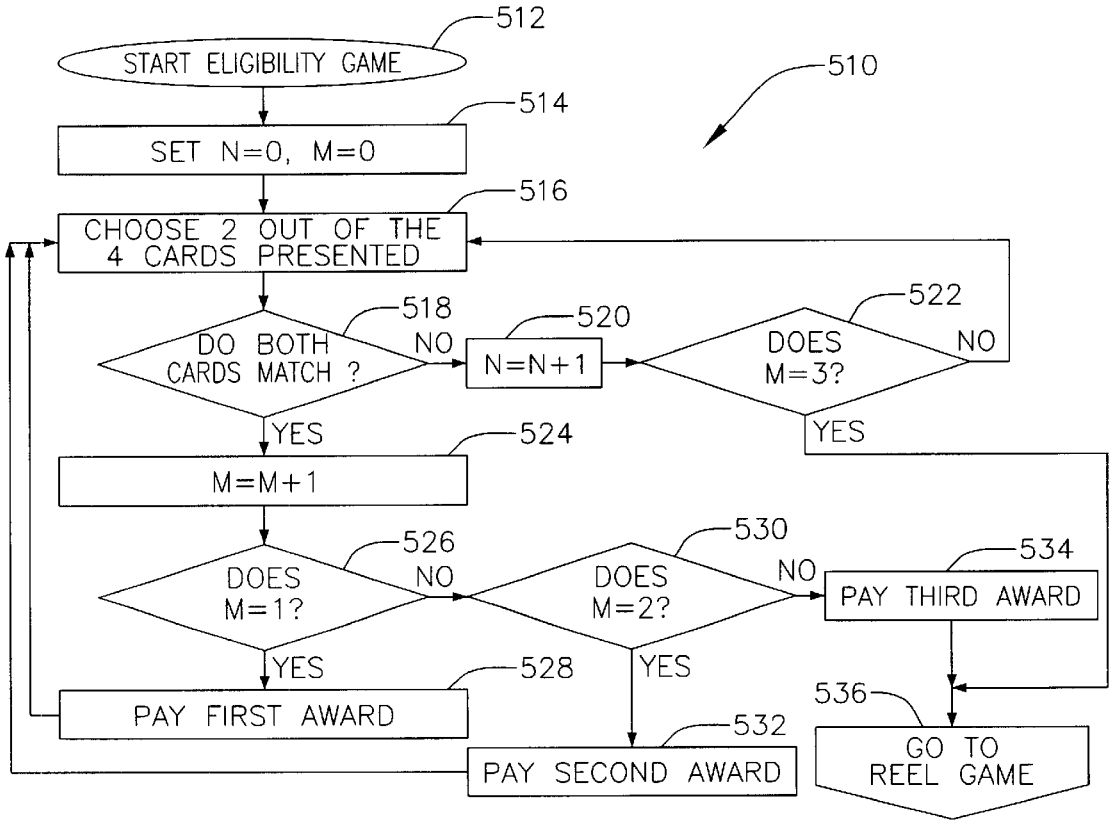
FIG. 13 is a flowchart of the method of the eligibility game of the alternate embodiment of the present invention.

More particularly, and referring now to FIG. 12, the first portion of the methodology of the alternate embodiment 410 is show in the flowchart. The game starts at 412 and the player elects which payines to play at box 414 by paying money or playing existing credits. Thereafter, the reels spin either automatically due to maximum credits being played or due to the player depressing the appropriate spin button as shown in box 416. Then a determination is made as to whether a winning outcome has occurred on the reels due to symbols aligning on the selected paylines in accordance with the paytable as shown at decision diamond 418. If a winning outcome or outcomes is found on the reels payment or credit is paid according to the paytable as shown at box 422.

Next, whether a win occurred on the reels or not, a determination is made as to whether any special symbols have appeared on the selected paylines as shown in decision diamond 420. If no such special symbols have appeared on the reels, then the process starts over at 412. Otherwise, any special symbols appearing on the reels are activated in a corresponding position (reel position to cell position) in the matrix corresponding to the special symbol depicted as shown at box 424.

Next a determination is made as to whether any of the three matrices have been filled as indicated by decision diamonds 426, 428, and 432. If any have been filled, then a winning outcome is awarded according to the matrix paytable for each matrix filled and the filled matrices are then cleared or the symbols deactivated as shown at box 430.

In the even the third or last matrix is filled, the player is then eligible to play the eligibility game 510 as indicated at 434. Eligibility game 510 starts at 512. First, counters N and M are set to zero as shown at box 514. These counters are necessary to determine if the player has used up the available guesses or won the maximum award.

Next, four cards are displayed on the screen and the player is allowed to turn two over as shown in box 516. Then a determination is made as to whether the two chosen cards match as shown in decision diamond 518. If the cards do not match, N is incremented by one (one of the players incorrect guesses has been used) as shown at box 520 and a determination is made as to whether all three incorrect guesses have been used as shown at decision diamond 522. If the player has guesses remaining, the process goes back to box 516 where the player is shown four cards face down again and gets to pick two again. If no guesses are left, the normal reel game is again presented and started as in box 536 and 412.

On the other hand, if the player chooses two cards that match, M is incremented by one (the player won one of the prizes) as shown in box 524 and a determination is made as to which prize was won as shown at decision diamonds 526 and 530. Simply put, if the player guesses correctly three times before guessing incorrectly three times, the player wins all three prizes in order as shown in boxes 528, 532, and 534. After winning the third and final prize, the reel game is presented on the display for further play as shown in boxes 536 and 412.

While embodiments and applications of this invention have been shown and described, it would be apparent to those skilled in the art that many more modifications than mentioned above are possible without departing from the inventive concepts herein. The invention, therefore, is not to be restricted except in the spirit of the appended claims.

What is claimed is:

1. A method for playing a game of chance comprising:

presenting a plurality or reels on a display, each reel configured to present game symbols defining an outcome, at least one symbol for each reel designated as a special symbol;

providing a plurality of pay lines on the display;

the player, for each game of play, enabling a number of a plurality of pay lines by making a wager;

based upon the number of play lines enabled, displaying a matrix of cells corresponding to stop positions on said reels, said matrix display persisting through subsequent game plays until reset;

spinning said reels and stopping said spinning reels to display an outcome of symbols of symbols for each enabled pay line;

determining for each enabled pay line whether said symbol combination is a winning symbol combination compared to predefined winning outcomes;

issuing an award based upon each winning symbol combination;

displaying each special symbol of said outcome in a corresponding cell position of said matrix and determining whether displaying the special symbol in the cell position is a winning special symbol combination compared to predefined winning combinations; and issuing an award for special symbol winning combinations and resetting the cells of the matrix by removing the special symbols therefrom.

2. The method of claim 1 comprising providing on the matrix a number of pay lines corresponding to the number of pay lines enabled and determining whether displaying the special symbol in the cell position is a winning special symbol combination on a matrix pay line compared to predefined winning combinations.

3. An electronic apparatus for playing a game of chance comprising:

a display;

a computer processor;

a plurality or reels at the display, each reel configured to present an outcome matrix of game symbols, at least one symbol for each reel designated as a special symbol;

means for the player to, for each game play, enable pay lines at the display by making a wager;

said processor configured to (i) display a matrix of cells corresponding to said outcome matrix and (ii) display said matrix of cells persisting through subsequent game plays until reset;

said processor configured to control the display at said display spinning said reels and stopping said spinning reels to display an outcome of symbols for each enabled pay line, determine for each enabled pay line whether said symbol combination is a winning symbol combination compared to predefined winning outcomes and issue an award based upon each winning symbol combination; and said processor configured to displaying each special symbol from said outcome in a corresponding cell position of said cell matrix, determine whether displaying the special symbol in the cell position is a winning special symbol combination compared to predefined winning combinations, issue an award for special symbol winning combinations and reset the cells of the matrix for the cells of the winning combination by removing the special symbols therefrom.

4. The apparatus of claim 3 comprising said processor configured to display said cell matrix including pay lines corresponding to the enabled pay lines, determine whether displaying the special symbol in the cell position is a winning special symbol combination on any enabled pay line compared to predefined winning pay line combinations, issue an award for special symbol winning pay line combinations and reset the cells of the matrix for the cells of the winning pay line combination by removing the special symbols therefrom.

* * * * *